US006250580B1

(12) United States Patent
Madrzak et al.

(10) Patent No.: US 6,250,580 B1
(45) Date of Patent: Jun. 26, 2001

(54) METHOD AND APPARATUS FOR CONTINUOUS WINDING OF A WEB OF MATERIAL

(75) Inventors: Zygmunt Madrzak, Heidenheim; Roland Möller, Herbrechtingen, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/256,174

(22) Filed: Feb. 24, 1999

(30) Foreign Application Priority Data

Feb. 25, 1998 (DE) ..... 198 07 897

(51) Int. Cl.[7] ..... B65H 19/28

(52) U.S. Cl. ..... 242/533.2; 242/541.6; 242/542.3

(58) Field of Search ..... 242/541.4, 541.5, 242/541.6, 542.3, 547, 531, 531.1, 533.2

(56) References Cited

U.S. PATENT DOCUMENTS 3,743,199 * 7/1973 Karr et al. ..... 242/532.2

(List continued on next page.)

FOREIGN PATENT DOCUMENTS 3539980 5/1986 (DE) .
3635197 2/1988 (DE) .

(List continued on next page.)

OTHER PUBLICATIONS

Patent Abstracts of Japan 62–19253, M–667, vol. 12, No. 45, Feb. 25, 1986.

An English Language abstract of DE 197 35 590.

Patent Abstracts of Japan 4–153153 A., M–1310, Sep. 14, 1992, vol. 16, No. 440.

(List continued on next page.)

*Primary Examiner*—Michael R. Mansen
(74) *Attorney, Agent, or Firm*—Greenblum & Berstein, P.L.C.

(57) ABSTRACT

Process and winding machine for the continuous winding of a web of material onto a reel spool to form a reel. The process includes forming a winding nip between a peripheral zone of a reel drum the reel, guiding the material web over the peripheral zone of the reel drum, positioning the reel in a secondary zone, and displacing and pressing the reel drum against the reel in the secondary zone. In this manner, one of control and regulation of a linear force in the winding nip occurs through the displacement of the reel drum. Upon obtaining a completed reel having a desired reel diameter, the process includes moving the reel drum into a temporarily fixed position, introducing a new, empty reel spool into a primary zone, forming another winding nip between the new spool and the reel drum through a relative movement of the new reel spool with respect to the reel drum in the temporarily fixed position, cutting the material web, winding the material web onto the new reel spool to form a new reel, and removing the completed reel. The process also includes transferring the new reel spool from the primary zone to the secondary zone, releasing the reel drum from the temporarily fixed position, and displacing the reel drum for one of the control and regulation of the linear force in the winding nip between the reel drum and the new reel spool in the secondary zone. The winding machine includes a reel drum arranged to form a winding nip with the reel, a primary mount adapted to hold a new reel spool, wherein the primary mount is further adapted to displace the new reel spool along a first guide path substantially radially to the reel drum, and a secondary mount coupled to the reel spool. The machine also includes a pressure device coupled to the reel drum, which is adapted to move the reel drum at least substantially horizontally when the reel spool is in the secondary mount, and which is further adapted to at least temporarily fix a position of the reel drum when the new reel spool is in the primary mount.

29 Claims, 3 Drawing Sheets

U.S. PATENT DOCUMENTS

| | | | | |
|---|---|---|---|---|
| 4,634,068 | | 1/1987 | Malkki et al. . | |
| 4,934,619 | * | 6/1990 | Snygg | 242/521 |
| 5,184,787 | | 2/1993 | Holzinger et al. . | |
| 5,249,758 | | 10/1993 | Müller et al. . | |
| 5,370,327 | * | 12/1994 | Adamski | 242/533.1 |
| 5,560,566 | * | 10/1996 | Bagnato | 242/541.1 |
| 5,611,500 | | 3/1997 | Smith . | |
| 5,673,870 | * | 10/1997 | Fielding et al. | 242/542.3 |
| 5,931,406 | * | 8/1999 | Siebert | 242/541.4 |
| 6,036,137 | * | 3/2000 | Myren | 242/541.7 |

FOREIGN PATENT DOCUMENTS

| | | | |
|---|---|---|---|
| 4007329 | | 9/1991 | (DE) . |
| 4304469 | | 8/1994 | (DE) . |
| 0697006 | | 10/1996 | (DE) . |
| 19607349 | | 8/1997 | (DE) . |
| 19735590 | | 11/1998 | (DE) . |
| 19737709 | | 11/1998 | (DE) . |
| 4153153 | | 5/1992 | (JP) . |
| 93/24401 | | 12/1993 | (WO) . |
| 94/26641 | | 11/1994 | (WO) . |
| 97/22543 | * | 6/1997 | (WO) . |
| 98/52858 | | 11/1998 | (WO) . |

OTHER PUBLICATIONS

Patent Abstracts of Japan 61–75760 A., M–510, Aug. 23, 1986, vol. 10, No. 246.

* cited by examiner

METHOD AND APPARATUS FOR CONTINUOUS WINDING OF A WEB OF MATERIAL

CROSS-REFERENCE TO RELATED APPLICATIONS

The present application claims priority under 35 U.S.C. §119 of German Patent Application No. 198 07 897.8, filed on Feb. 25, 1998, the disclosure of which is expressly incorporated by reference herein in its entirety.

BACKGROUND OF THE INVENTION

1. Field of the Invention

The present invention is related to a process for the continuous winding of a web of material, e.g., a paper or cardboard web, onto a reel spool to form a reel (or wound roll) and a winding machine for the continuous winding of a web of material, e.g., a paper or cardboard web, onto a reel spool to form a reel.

2. Discussion of Background Information

Processes and winding machines of the type discussed here are used in conjunction with a machine for the production or processing of a web of material, e.g., a paper or cardboard web. German Application No. DE 197 35 590.0 discloses a process and a winding machine, in which the web of material is guided over a peripheral zone of a reel drum, which forms a winding nip (or gap) with a reel. In the wind-up phase, the increasing diameter of the reel (or wound roll) is compensated for by a relative movement of the reel with respect to the reel drum, and the linear force in the winding nip is controlled by displacement of the reel drum. In preparation for a reel spool change, a new reel spool for winding a new reel is introduced into a primary zone above the reel drum, where a winding nip is formed between the new drum and the reel drum by a relative movement between the reel drum and the new reel spool. The web of material is cut and its free end is wound onto the new reel spool. The new reel spool is transferred with the newly created reel over a peripheral zone of the reel drum into a lower secondary zone. During winding in the primary zone and during the transfer, compensation for the increasing reel diameter and control of the linear force in the winding nip is effected by displacement of the reel drum. During the remainder of the winding process, i.e., when the reel is positioned in the second zone, growth of the diameter of the reel is compensated for by a relative movement of the reel with respect to the reel drum along a guide path, and the linear force in the winding nip is controlled by displacement of the reel drum. It has been demonstrated that adjustment of the linear force during winding in the primary zone is not possible with adequate sensitivity in all cases, which has a disadvantageous effect on winding quality.

Further, German Application No. DE 35 39 980 discloses a winding machine in which the winder reel spool is permanently stationarily mounted. This stationary mounting of the winder reel spool results in the disadvantage that the linear force in the winding nip between the winder reel spool and the reel located in the secondary zone cannot be controlled or regulated with adequate sensitivity, i.e., due to the very high weight of the reel to be moved under certain circumstances. It is noted that there is often a requirement to produce reels having extremely large diameters, e.g., on the order of 3 to 4 meters.

SUMMARY OF THE INVENTION

The present invention provides a process and a winding machine which does not suffer from the disadvantages of the above-noted winding machines.

Accordingly, the present invention provides a process that, during a continuous winding process, guides the web of material over a peripheral zone of a reel drum through a winding nip formed between a reel drum and a reel, so that the web is wound onto the reel. During this winding phase, i.e., in a secondary zone, the reel drum is pressed against the reel, such that control or regulation of the linear force in the winding nip occurs through displacement of the reel drum. Upon the reel reaching or attaining a desired diameter, and in preparation for a reel spool change, the reel drum is displaced or moved into a fixed position, so that the position of the reel drum is temporarily fixed. This movement may be effected so that, e.g., contact with the reel is maintained while also maintaining the desired linear force. A new and still empty reel spool is introduced into a primary zone, and a new winding nip is formed between the new reel and the reel drum by relative movement of the new reel spool and the reel drum in its fixed position. The web of material is cut, and winding of the web of material into a new reel on the new reel spool begins. The separated or completed reel is removed from the secondary zone and the new reel spool, and the new reel thereon, is transferred from the primary zone into the secondary zone. During winding in the primary zone, during the transfer process, and during a variable period of time after reaching the secondary zone, the linear force in the winding nip is controlled or regulated by relative movement of the reel with respect to the reel drum held in its stationary position. By this displacement of the reel for adjustment of the linear force to a specified, preferably variable, value, increasing diameter is automatically compensated for. The stationary position of the reel drum is then released or canceled such that the reel drum can be displaced, preferably horizontally or substantially horizontally, for controlling or regulating the linear force in the winding nip. During this winding phase, increasing reel diameter is compensated for, preferably by relative movement of the reel relative to the reel drum. The above-described process is repeated with each reel spool change.

The weight of the reel drum is greater than the weight of an empty reel spool and also greater than the weight of a reel having only a few layers of winding. Thus, the weight to be moved for the control or regulation of the linear force in the winding nip at the beginning of the winding process is relatively low as compared to the weight of the reel drum. In this manner, during the initial winding process, a particularly sensitive adjustment of the linear force is possible. This, in turn, enables optimal core winding and, therefore, a defined buildup of the reel, which improves the winding result. Thus, only after the reel has been transferred into the secondary zone, does a change in the control movement to adjust the linear force occur. For this, as already described, the stationary positioning of the reel drum is released so that it may be displaced for adjustment of the linear force, while compensation for increasing reel diameter is preferably provided by relative movement of the reel with respect to the reel drum. The release of the reel drum from the stationary positioning is effected because, with the production of very large reel diameters, the customary maximum thrust distance of the displacement of the reel drum is, as a rule, inadequate for a stationary positioning of the reel.

With the process according to the present invention, a good winding result, i.e., a reel with a defined, uniform reel hardness, may be obtained. This result is attained because an extremely fine regulation of the linear force in the winding nip between the reel drum and the reel is possible during the beginning of the winding process and during the transfer of the reel spool into the secondary zone.

The present invention also provides a winding machine that includes a reel drum, which can be displaced, preferably substantially horizontally, via a pressure device. A web of material, e.g., a paper or cardboard web, is guided over a peripheral zone of the reel drum and onto a reel spool to be wound into a reel (wound roll). The reel spool and the reel drum form a winding nip, through which the web of material is guided. The winding machine also has a primary mount containing a new reel spool, and a secondary mount for the reel spool and reel. The primary mount displaces the new reel spool along a first guide path that is radial to the reel drum. The reel drum, when the new reel spool is the primary mount, may be temporarily fixed in a fixed position, and, when the new reel spool is transferred into the secondary mount, may be displaced, preferably horizontally or substantially horizontally, via the pressure device.

Based upon this design of the winding machine, with which the above-described process may be realized, the linear force in the winding nip may be particularly sensitively adjusted during winding in the primary zone by relative displacement of the new reel spool, which may include a few layers of a new reel thereon, with respect to the temporarily fixed reel drum. Thus, a particularly good core winding of the reel spool is possible, which increases the quality of the reel. During the subsequent winding in the secondary zone, the control of the linear force occurs again in accordance with the above-mentioned German Application No. DE 197 35 590.0, the disclosure of which is expressly incorporated by reference herein in its entirety.

Accordingly, the present invention is directed to a process for the continuous winding of a web of material onto a reel spool to form a reel. The process includes forming a winding nip between a peripheral zone of a reel drum and the reel, guiding the material web over the peripheral zone of the reel drum, positioning the reel in a secondary zone, and displacing and pressing the reel drum against the reel in the secondary zone. In this manner, one of control and regulation of a linear force in the winding nip occurs through the displacement of the reel drum. Upon obtaining a completed reel having a desired reel diameter, the process includes moving the reel drum into a temporarily fixed position, introducing a new, empty reel spool into a primary zone, forming another winding nip between the new reel spool and the reel drum through a relative movement of the new reel spool with respect to the reel drum in the temporarily fixed position, cutting the material web, winding the material web onto the new reel spool to form a new reel, and removing the completed reel. The process also includes transferring the new reel spool from the primary zone to the secondary zone, releasing the reel drum from the temporarily fixed position, and displacing the reel drum for one of the control and regulation of the linear force in the winding nip between the reel drum and the new reel spool in the secondary zone.

In accordance with another feature of the present invention, the release of the reel drum from the temporarily fixed position occurs after a diameter of the new reel has reached a predefined value.

In accordance with another feature of the present invention, during the one of the control and regulation of the linear force by displacement of the reel drum, the process further includes relatively moving the reel with respect to the reel drum to compensate for increasing reel diameter.

In accordance with another feature of the present invention, before the winding of the material web onto the new reel spool, the process includes forming a free draw of the material web between the reel drum and an almost completed reel. Further, while the material web is guided in the free draw from the reel drum to the almost finished reel, a winding gap is formed between the reel and a pressure roller.

In accordance with another feature of the present invention, after the new reel has been transferred from the primary zone to the secondary zone, the new reel is held stationary for a period of time.

In accordance with another feature of the present invention, during the winding in the primary zone and during the transfer of the new reel from the primary zone to the second zone, the process further including pressing the new reel with one of controllable and regulatable force against the reel drum in the temporarily fixed position. Further, the new reel spool, which has been transferred into the secondary zone under the one of controllable and regulatable force is pressed against the reel drum in the temporarily fixed position.

In accordance with another feature of the present invention, the web of material is composed of one of a paper and a cardboard web.

The present invention is also directed to a winding machine for the continuous winding of a material web onto a reel spool and to form a reel that includes a reel drum arranged to form a winding nip with the reel, a primary mount adapted to hold a new reel spool, wherein the primary mount is further adapted to displace the new reel spool along a first guide path substantially radially to the reel drum, and a secondary mount coupled to the reel spool. The machine also includes a pressure device coupled to the reel drum, which is adapted to move the reel drum at least substantially horizontally when the reel spool is in the secondary mount, and which is further adapted to at least temporarily fix a position of the reel drum when the new reel spool is in the primary mount.

In accordance with another feature of the present invention, the primary mount includes a displaceable primary pressure device to which the new reel spool is rotatably coupled, and which is adapted to displace the new reel spool in a direction of one of toward a periphery of the reel drum and away from the periphery of the reel drum.

In accordance with another feature of the present invention, the primary mount includes a displaceable primary pressure device to which the new reel spool is rotatably coupled, and which is adapted to press the new reel spool with one of a controllable and regulatable force against the reel drum.

In accordance with another feature of the present invention, the primary mount includes a primary pressure device arranged to act on the new reel spool, and the pressure device further includes a pressure source, a pressure control device, and a valve which is adapted to temporarily couple the primary pressure device to the pressure source through the pressure control device. Further, a valve arrangement is adapted to supply one of a controlled and regulated pressure to one of the cylinder and the primary pressure device.

In accordance with another feature of the present invention, the pressure device includes a cylinder, a pressure source, a pressure control device, and a valve which is adapted to alternatively couple the cylinder to one of directly to the pressure source and to the pressure source through the pressure control device. The pressure control device may be a regulator. Further, the primary mount includes a primary pressure device arranged to act on the new reel spool, and the pressure device further includes a second valve which is adapted to temporarily couple the primary pressure device to the pressure source through the pressure control device. Still further, the valve and the second valve are adapted to be temporarily coupled, through a common line, to the regulator and the pressure source. Both the cylinder and the primary pressure device are temporarily supplied with the one of the controlled and regulated pressure. Further still, a pressure reducing element may not be provided between the valve and the cylinder. The pressure reducing element is adapted to gradually reduce the maximum pressure prevailing in the cylinder to the one of the controlled and regulated pressure.

The present invention is also directed to a process for winding continuous material web reels on reel spools in a winding device that includes a reel drum, a secondary zone in which axes of the reel drum and a reel being wound are substantially horizontally oriented, and a primary zone in which a new reel spool is to be arranged to begin winding of the reel. The process includes moving the reel drum to a temporarily fixed position, forming a primary winding nip between the reel drum and the new reel spool in the primary zone, adjusting a nip pressure in the primary winding nip, and winding the continuous material web on the new reel spool to form a first reel. The process also includes transferring the second reel from the primary zone to the secondary zone such that the primary winding nip is moved to becomes a secondary winding nip between the reel drum and the second reel in the secondary zone, releasing the reel drum from the temporarily fixed position, and adjusting a nip pressure in the secondary winding nip between the reel drum and the first reel in the secondary zone.

In accordance with another feature of the present invention, the winding device includes a pressure source and a pressure control device and a first and second pressure device, the process further includes alternatively coupling the first pressure device to one of directly to the pressure source and indirectly to the pressure source through the pressure control device to move the reel drum and to adjust the nip pressure in the secondary winding nip, and selectively coupling the second pressure device to the pressure source through the pressure control device to adjust the nip pressure in the primary winding nip.

Further, the first pressure device includes a piston coupled to the reel drum and a cylinder, and the moving of the reel drum into the temporarily fixed position includes coupling the first pressure device directly to the pressure source, and moving a piston to an end position within the cylinder. In this manner, the reel drum is correspondingly moved to an end position. Further, the adjusting of the nip pressure in the primary winding nip includes coupling the second pressure device to the pressure source through the pressure control device. In this manner, the pressure applied to the second pressure device is less than the pressure applied to the first pressure device. Further, maintaining nip pressure between the reel drum and the first reel via the second pressure device during the transfer of the first reel from the primary zone to the secondary zone.

Still further, when the first reel is transferred into the secondary zone, the process further includes switching the first pressure device from a connection directly to the pressure source to indirectly to the pressure source through the pressure control device, reducing a pressure within the first pressure zone to correspond to a pressure applied through the pressure control device, and concurrently coupling the second pressure device to the pressure source through the pressure control device. Further, the process includes moving the reel drum and the first reel until the piston is positioned at a mid-point within the cylinder.

In accordance with another feature of the present invention, the process further including moving the first reel radially outwardly from the reel drum to compensate for increasing diameter of the first reel, completing the first reel to a predetermined diameter, positioning a new reel spool in the primary zone, winding a second reel on the new reel spool in the primary zone, removing the first reel, and transferring the second reel from the primary zone to the secondary zone. Further, prior to completing the first reel to the predetermined diameter, the process further includes separating the first reel from the reel drum to form an open draw of the material web, and pressing a pressure roll against the first reel to form a reel nip at an end of the open draw.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
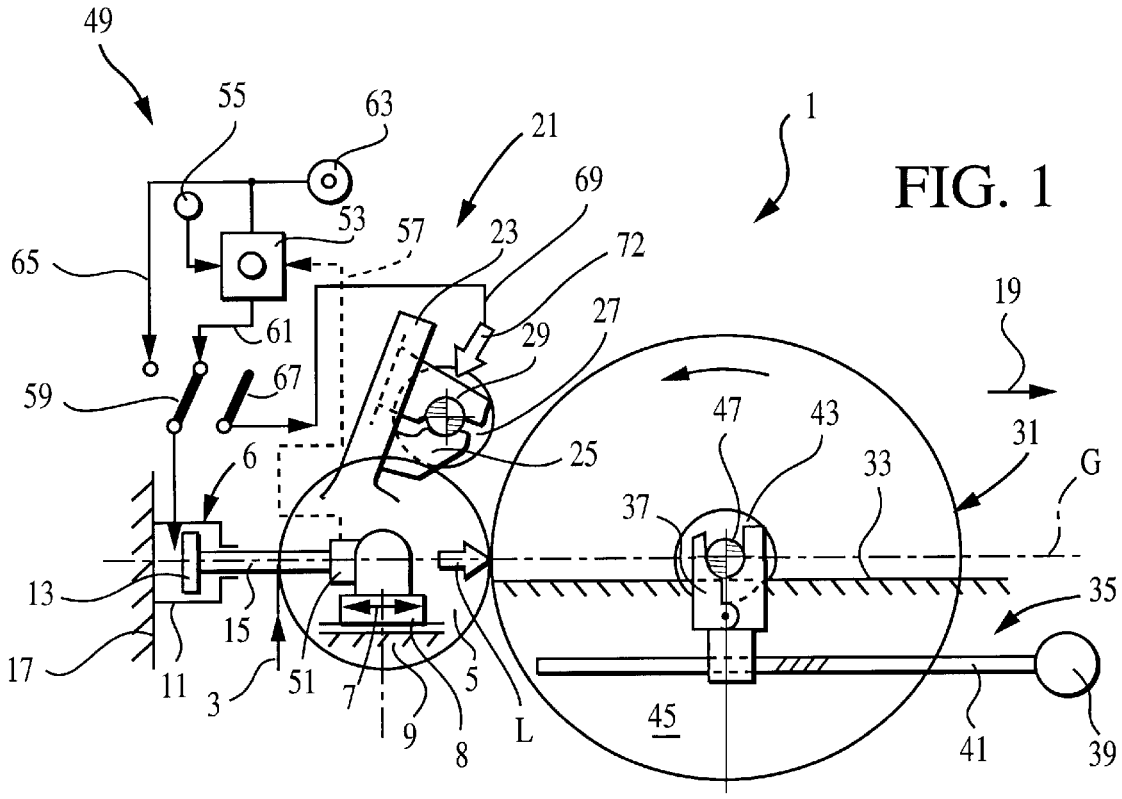
FIGS. 1, 2, 3, 4, and 5 illustrate various winding phases in an exemplary embodiment of a winding machine of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1–5 schematically illustrate various stages or a sequence of functional steps within an exemplary embodiment of a winding process utilizing a winding machine 1. Winding machine 1 may be utilized for winding of a web of material 3, e.g., a paper or cardboard web, onto a reel spool 43 to form a reel or wound roll 45.

Winding machine 1 includes a reel drum 5, also known as a support reel spool or support roll, which can be displaced via a pressure device 6 in a direction indicated by double arrow 7, e.g., along an imaginary horizontal line G (depicted by a broken line). Reel drum 5, which is driven by a drive, preferably a center drive, is held rotatably coupled on a guide sled 8, which can travel along a substantially horizontal guide 9. Pressure device 6, as shown in the exemplary embodiment, may be a hydraulic piston/cylinder unit, which includes a piston 13 guided within a cylinder 11. Piston 13 may be solidly coupled with a piston rod 15 that engages guide sled 8 and cylinder 11 may be coupled to machine frame 17 (indicated but not detailed). Thus, with outward movement of piston rod 15 out of the cylinder 11, guide sled 8 and therefore, reel drum 5 (shown in FIG. 1) are displaced toward the right in a direction of an arrow 19. With inward movement of piston rod 15 into cylinder 11, displacement of reel drum 5 (in FIG. 1) occurs toward the left.

Winding machine 1 also includes a primary mount 21, which includes two swivelling levers 23 (of which only one is depicted in FIG. 1). Swivelling levers 23 can pivot around a stationary axis that extend perpendicular to the plane of FIG. 1. A holding arrangement 25, which can be displaced relative to or along swivelling levers 23, e.g., via a primary pressure device that is schematically illustrated with an arrow 72, is coupled to swivelling levers 23. Holding arrangement 25 may be utilized for rotationally movably holding and guiding of a reel spool 27.

In the winding phase depicted in FIG. 1, an empty reel spool 27 may be held by holding arrangement 25 at a distance from reel drum 5, i.e., in a "ready position." A center drive (or primary drive) 29, which applies torque to reel spool 27 held by primary mount 21 (or holding device 25), grips reel spool 27, which is empty (i.e., winding on reel spool 27 has not yet begun). As depicted in exemplary embodiment shown in FIGS. 1–5, the primary pressure device (depicted by arrow 72) may be a piston/cylinder unit, which is substantially similar in design to pressure device 6. Alternatively, a spindle drive or similar type device may be utilized for displacing holding arrangement 25 relative to or along swivelling levers 23. The function of primary mount 21 is discussed in greater detail hereinbelow.

Winding machine 1 also includes a secondary mount 31, which includes substantially horizontally disposed rails 33 and a transport device 37, which is movable via a lifting device 35. Lifting device 35 may be formed, e.g., by a spindle drive, which includes a threaded spindle 41 driven by an electric motor 39. Transport device 37 may be utilized to hold and guide a reel spool 43, upon which a reel 45 is wound, lying on rails 33 as shown in FIG. 1. A center drive, schematically illustrated, e.g., as a secondary drive 47, which drives reel spool 43 held by secondary mount 31 via transport device 37. Secondary drive 47 may be jointly displaceable in a known manner along with transport device 37 substantially parallel to rails 33.

In FIG. 1, reel spool 43 may be arranged or located within a secondary zone. The term "secondary zone" refers to a portion of the winding process in which reel 43 lies on rails 33 of secondary mount 31 and is possibly displaced on them along a second linear guide path, e.g., along line G.

In the winding phase illustrated in FIG. 1, reel drum 5 may be pressed against a periphery of reel 45, which is wound on reel spool 43, via pressure device 6 in a defined manner. In this way, a winding nip is formed between reel 45 and reel drum 5. Material web 3 is guided over a peripheral zone of reel drum 5 and wound onto reel 45. A linear force (depicted by arrow L) in the winding nip between reel drum 5 and reel 45, which is lying on rails 33 and which is guided by transport device 37, may be adjusted or optimized by displacement or movement of reel drum 5 in the direction of double arrow 7. Accordingly, in the exemplary embodiment, a regulation device 49 is provided. In adjusting linear force L, reel drum 5 may be displaced only relatively slightly in the direction of double arrow 7 from a middle position, in which piston 13 is positioned roughly in the center of cylinder 11. Reel drum 5, as compared to the ever increasing diameter and weight of reel 45, has a lower weight so that a change in the displacement direction of reel drum 5 may be performed very quickly. Thus, changes occurring due to e.g., an imbalance of reel 43 and/or surges in the linear force, can be quickly compensated for. In this manner, a reel having a defined reel hardness or a uniform reel hardness curve can be formed.

Figure 2:
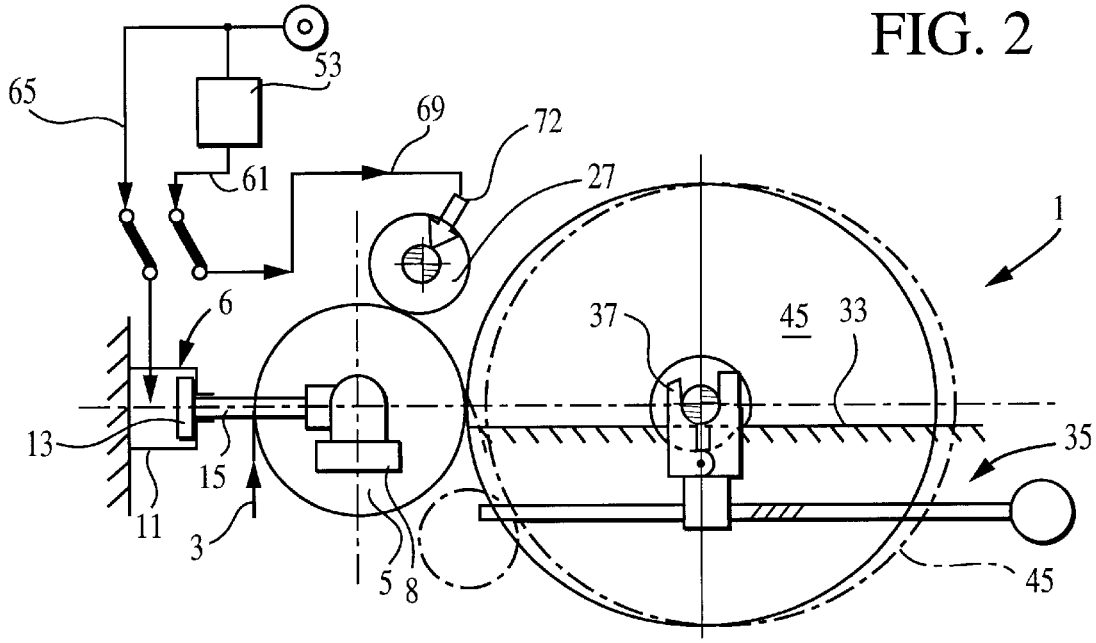

As discussed above, pressure device 6 and primary pressure device (depicted by arrow 72) are designed as hydraulic piston/cylinder units. Regulation device 49, described in greater detail hereinbelow, is especially suited for a hydraulic system and may be appropriately adapted or altered in an alternative embodiment (not shown in the figures) of the pressure device. Regulation device 49 includes a measurement device 51 for monitoring linear force L, a regulator 53, and a desired value transmitter 55. Measurement device 51 may be coupled with regulator 53 via a measurement line 57. Regulating device 49 also includes a first valve 59, which is switchable into two functional positions. In the first functional position, as depicted in FIG. 1, first valve 59 connects a line 61 coming from regulator 53 to cylinder 11. The pressure of the hydraulic fluid in line 61 is adjusted by regulator 53, and is less than a maximum pressure provided by a pressure source 63. The maximum pressure of the hydraulic system is provided in a bypass line 65, which bypasses regulator 53. In the second functional position of first valve 59, as depicted in FIG. 2, cylinder 11 of pressure device 6 is subjected to the maximum pressure of the hydraulic system. Regulation device 49 also includes a second valve 67, which is switchable into two functional positions. In a second functional position, second valve 67 connects line 61 to the cylinder of the primary pressure device (depicted by arrow 72) via line 69, as depicted in FIG. 2. In the first functional position of the valve 67, as depicted in FIG. 1, the connection between line 61 and the primary pressure device is interrupted.

The function of winding machine 1, the process, and regulation device 49 are explained in greater detail with reference to a winding process. Material web 3 is guided over reel drum 5 and wound onto reel 45, which is held by secondary mount 31, as shown in FIG. 1. Valves 59 and 67 of regulation device 49 are held or maintained in their first functional position, i.e., cylinder 11 of pressure device 6 is subjected to the adjusted pressure line 61 via regulator 53. Thus, reel drum 5 may be shifted toward the right in the direction of arrow 19 and pressed, in a defined manner, against reel 45. If the value of linear force L in the winding nip formed between reel drum 5 and reel 45, which is measured by measurement device 51, differs from the desired value output by desired value transmitter, regulator 53 immediately changes the pressure of the hydraulic fluid in line 61 and, thereby, in cylinder 11, so that the measured value of linear force L approaches the desired value. Thus, linear force L may also be held, e.g., at a constant value if a disruption occurs in the winding process. A disruption may be, e.g., travel of transport device 31 that is not entirely precise, i.e., the position of the winding nip formed by reel drum 5 and reel 45 shifts slightly. Compensation for the increasing diameter of reel 45 guided and held by secondary mount 31 is realized during this winding phase by travel of transport device 37 in direction of arrow 19 via lifting device 35.

To prepare for a reel spool change, e.g., upon obtaining a desired diameter for reel 45, reel drum 5 and reel 45 may be jointly moved in the direction of arrow 19. This movement may be effected by moving, via lifting device 35, transport device 37, which holds reel 45, in the direction of arrow 19, and reel drum 5 may be automatically readjusted to reel 45 to maintain linear force L to the desired value. Accordingly, reel drum 5 follows reel 45 until piston 13 of the pressure device 6 reaches a stop, e.g., against a wall of cylinder 11.

At this point, valve 59 and 67 of regulation device 49 are switched into their second functional positions. Thus, cylinder 11 of pressure device 6 is subjected to the maximum pressure of the hydraulic system, i.e., of pressure source 63, and the cylinder of the primary pressure device (depicted by arrow 72) is subjected to less pressure, i.e., to the pressure prevailing in line 61 for the adjustment of the linear force in the new winding nip between reel spool 27 and reel drum 5. This yields the following situation: empty reel spool 27, which is held by primary mount 21 and which is accelerated by primary drive 43 to web speed, is displaced from its ready position (depicted in FIG. 1) into the so-called "primary position," i.e., pressed against the periphery of reel drum 5 in a defined manner. This contact occurs via movement effected by the primary pressure device depicted in the figures with an arrow 72. Because the forces pressing reel spool 27 against reel drum 5 are less than the forces pressing piston 13 against the stop, reel drum 5 is maintained in a fixed place, i.e., stationarily fixed. The term "stationarily fixed" means that, while rotation of reel drum 5 around its longitudinal axis is possible, translatory movement of reel drum 5 is prevented due to the imbalance of forces.

Figure 3:
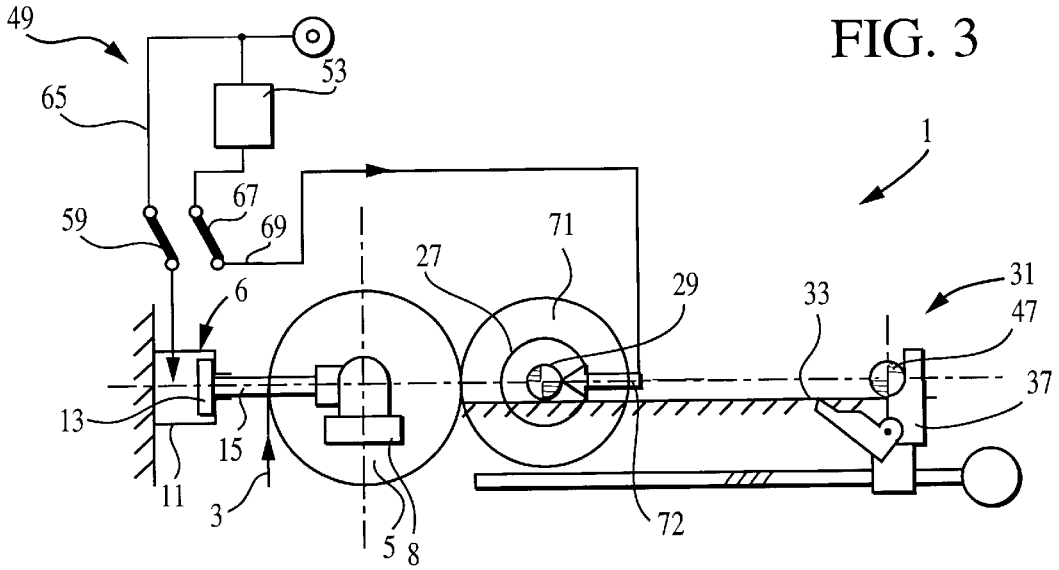

Material web 3 guided through the nip between empty reel spool 27 and reel drum 5 and through the former winding nip between reel drum 5 and reel 45 is cut by a separation device (not shown). Beginning with the starting end (leading edge) of the new web, material web 3 is wound onto empty reel spool 27. Finished reel 45 may now be moved in the direction of arrow 19, i.e., toward the right, to form or create an intermediate space between reel 45 and reel drum 5, to a discharge position and decelerated. The reel spool 27, which at this point has only a few layers wound thereon, may be transferred into the secondary position. In this regard, the transfer of reel spool 27 may begin by lowering swivelling lever 23 of primary mount 21 clockwise from the primary position (as depicted in FIG. 2) into the secondary position (as depicted in FIG. 3) along a first, arcuate guide path. During the entire transfer process, reel spool 27, which is held by primary mount 21, may be driven by primary drive 29. Moreover, during the transfer process, the linear force in the winding nip between the new reel wound onto reel spool 27 and reel drum 5 is adjusted or regulated by displacement of reel spool 27 relative to reel drum 5, which is being temporarily held stationary. The adjustment or regulation is effected by regulator 53, which appropriately changes the pressure in line 61. By this regulation of the linear force, the increasing diameter of new reel 71 may be automatically compensated for.

In the winding phase depicted in FIG. 3, reel spool 27 has been positioned in the secondary zone, i.e., reel spool 27 lies on rails 33 of secondary mount 31. During the time in which reel spool 27, with reel 71 being rolled thereon, is being transferred from primary mount 21 to second mount 31, reel drum 5 remains fixed in its stationary position due to cylinder 11 being connected to the maximum pressure of the hydraulic system. In FIG. 3, reel 45, which has been completed or finished, is depicted as already removed from secondary mount 31. This removal occurs after reel 45 has been decelerated and separated from secondary drive 47.

Figure 4:
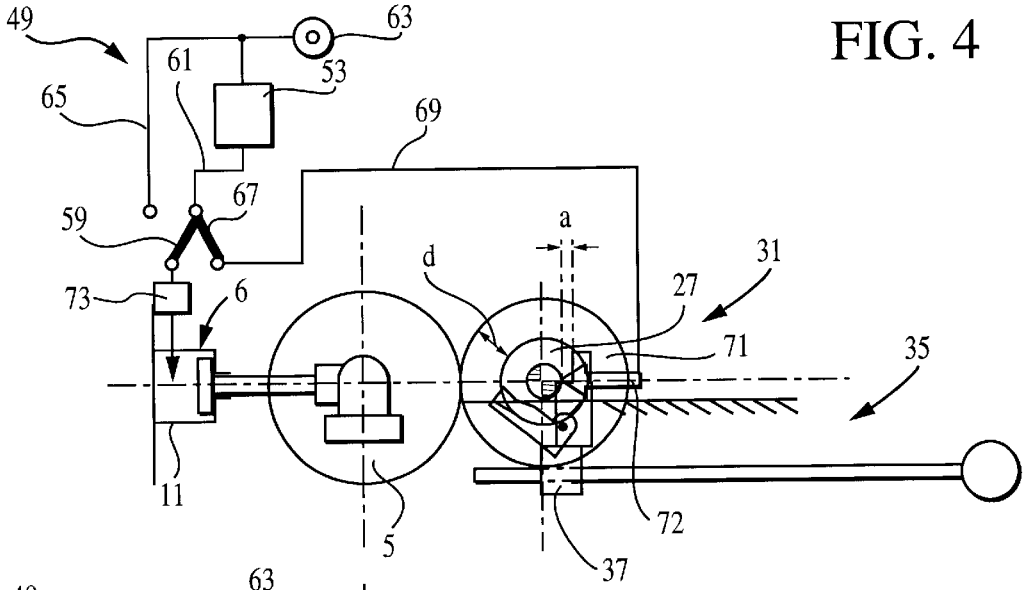
Figure 5:
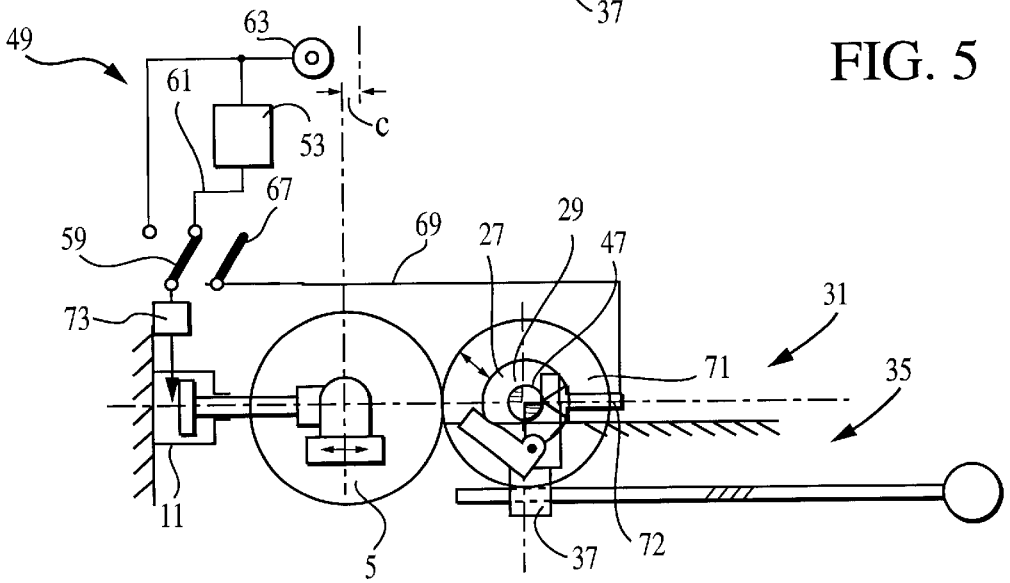

With reference to FIG. 4, after reel 71, which is wound on reel spool 27, has reached a desired layer thickness d, e.g., up to approximately 10 mm to 30 mm, and/or before the piston of the primary pressure device (depicted by arrow 72) has approached its cylinder end, reel spool 27 is transferred from primary mount 21 to second mount 31. For this transfer, transport device 37 of secondary mount 31 is moved from the discharge position (of reel 45) toward the left, i.e., in the direction toward reel spool 27. However, transport device 37 is stopped a distance a, e.g., approximately 5 mm, from reel spool 27. The pressure in cylinder 11 of pressure device 6 is now reduced under timed control from the maximum pressure of the hydraulic system to the control pressure in line 61. For this, first valve 59 is switched into the first functional position and the maximum pressure prevailing in cylinder 11 is gradually lowered via a pressure reducing element 73 to approximately the pressure prevailing in line 61. The distance a between reel spool 27 and transport device 37 decreases with the increasing diameter of reel 71. As shown in FIG. 5, when distance a is still very small, e.g., approximately 1 mm, lifting device 35 of secondary mount 31 begins to shift transport device 37 toward the left, and thereby, also moves reel spool 27 and reel drum 5 toward the left. Thus, the linear force in the winding nip between reel 71 and reel drum 5 can rise slightly during this movement toward the left. After a shifting movement c by reel drum 5, reel spool 27 lying on rails 33 remains temporarily in a fixed position, whereby piston 13 of pressure device 6 assumes roughly the central position within cylinder 11, as depicted in FIGS. 1 and 5. Finally, second valve 67 is also switched into the first functional position, whereby the pressure in the cylinder of the primary pressure device (arrow 72) is reduced to zero. From this time on, the regulation of the linear force is solely performed via pressure device 6, and the diameter compensation is performed by displacement of reel spool 27 via lifting device 35, which is moved by electric motor 39 and threaded spindle 41.

As shown in FIG. 5, during the transfer of reel spool 27 from primary mount 21 to secondary mount 31, both primary drive 29 and secondary drive 47 are coupled to reel spool 27. After reel spool 27 has been accepted by transport device 37, primary drive 29 is uncoupled and swivels or is pivoted, together with swivelling levers 23 of primary mount 21 (not shown in FIG. 5) counter-clockwise upwardly into the position depicted in FIG. 1. At this point, a new reel spool may be introduced into primary mount 21 for subsequent winding.

Figure 6:
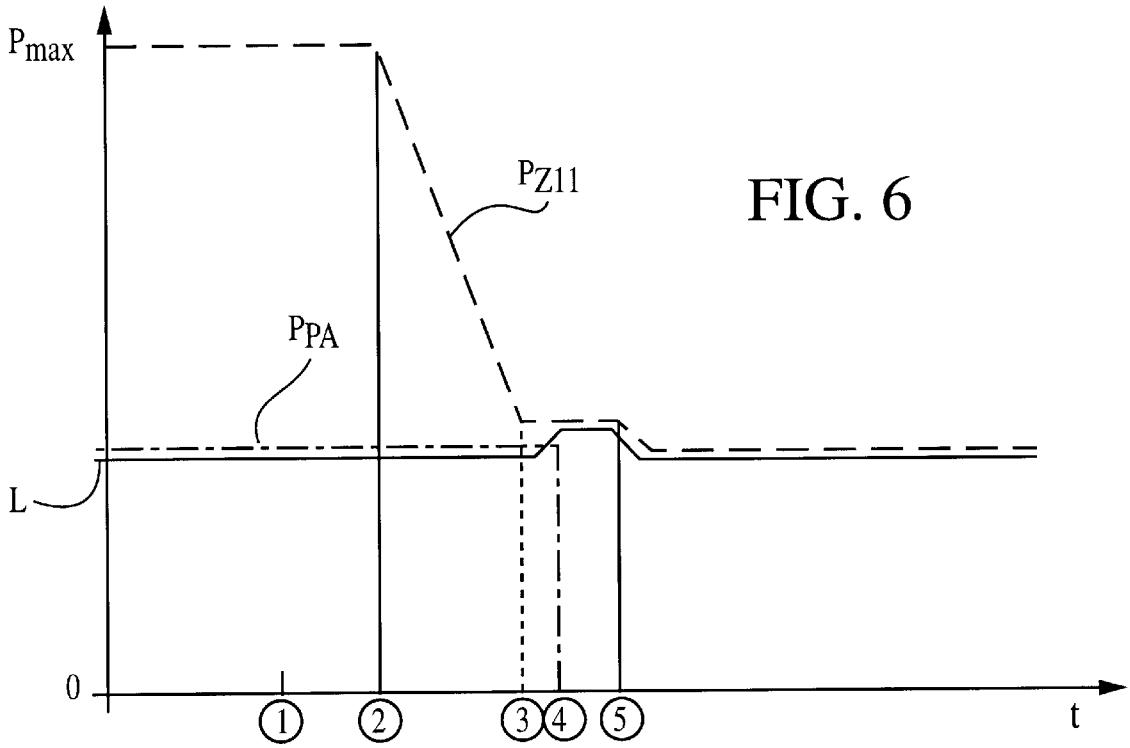
FIG. 6 illustrates a diagram of a curve of the linear force during the winding process.

FIG. 6 shows a diagram in which the linear force or pressure L in the winding nip between reel drum 5 and reel 45, the pressure in cylinder 11 of pressure device 6, and the pressure prevailing in the cylinder of the primary pressure device (arrow 72) before, during, and after a reel spool change is plotted. The pressure p is plotted on the ordinate axis while the time t is plotted on the abscissa. Pressure L in the nip between the reel and the reel drum is depicted by a solid line. In addition, the course of pressure $P_{z11}$ in cylinder 11 of pressure device 6 is depicted by a broken line, and the pressure $P_{PA}$ in the cylinder of the primary pressure device (arrow 72) is depicted by a dot-dash line. Pressure L, i.e., the linear force in the winding nip is depicted here, for the sake of example, as an essentially constant value, e.g., approximately 0.5 kN/m.

A plurality of times 1–5, which will be discussed in detail in the following, are depicted on the abscissa. At time 1, new reel 71, which is guided and held in primary mount 21, attains its desired layer thickness d shown in FIG. 4. From time 2 to time 3, the pressure in cylinder 11 ($P_{z11}$) is lowered by pressure reduction element 73, e.g., from approximately 5 kN/m to a pressure slightly higher than pressure ($P_{PA}$), while the pressure in the cylinder of the primary pressure device ($P_{PA}$) remains constant. At time 3, the pressure ($P_{z11}$) in cylinder 11 is slightly higher than the pressure ($P_{PA}$) prevailing in the cylinder of the primary pressure device, which is lowered to zero at time 4. At this point, the linear force is again controlled or regulated solely by adjustment of pressure ($P_{z11}$) in cylinder 11 such that the pressure in the nip between the reel and the reel drum increases slightly. At time 5, the pressure ($P_{z11}$) in cylinder 11 is again lowered slightly and, thereby, pressure L in the winding nip. The reason that the pressure $P_{z11}$ has not dropped at the time 3 to the pressure $P_{PA}$ in the cylinder of the primary pressure device is that, during the transfer of the reel spool from the primary mount to the secondary mount, a drop in the pressure in the winding nip should be prevented. A slight increase in pressure L in the winding nip at time 4, as depicted in the diagram, practically results in no noticeable change in the winding result.

At the time of the transfer of reel spool 27 from primary mount 21 to secondary mount 31, the two drives, i.e., primary drive 28 and secondary drive 47, are coupled, at least for a short time, with reel spool 27. This ensures that the reel spool can be subjected during the entire winding process to an exact, adjustable (drive/braking) torque.

Winding machine 1 is generally utilized for winding a material web 3. Winding machine 1 may be positioned at the end of a machine for the production or processing, e.g., conversion, of a material web, such as, e.g., a paper or cardboard web, to form a reel. Moreover, winding machine 1 may also be utilized to re-reel already wound reels.

In an alternative exemplary embodiment of the process implemented with winding machine 1, an almost finished reel 45, i.e., before material web 3 is transferred onto empty reel spool 27, can be guided by secondary mount 31 in the direction of arrow 19 toward the right into a position depicted by, e.g., the broken line in FIG. 2. In this variant of the process according to present invention, provision is made that, before the intermediate space is formed between reel 45 and reel drum 5, a pressure (or doctor) roller, located below reel 45, is pressed against the periphery of reel 45. The pressure roller is used to prevent entrainment of air between the winding layers of reel 45, e.g., when material web 3 is guided in a free or open draw from reel drum 5 to reel 45. The pressing force with which the pressure roller is pressed against the periphery of reel 45 is adjustable. The pressure roller may be driven by a drive, e.g., a center drive, preferably before and while the pressure roller is pressed against the periphery of reel 45 held by secondary mount 31.

The formation of intermediate space between the almost finished reel and the reel drum before a reel spool change provides room to introduce, e.g., a cutting device for separating the material web in the zone between the new reel spool, the reel drum, and the almost finished reel. It also possible to guide a current of a medium, e.g., an air current, into the intermediate space from below, which results, with the simultaneous deceleration of the almost finished reel, in the formation of a material web loop. In the region of the loop, the material web can be cut via a separation device. Of course, a "Nordic change" is also possible, i.e., the material web loop is wound into the nip between the empty reel spool and the reel drum. The material web then tears off. Such processes and devices for separation of the material web are generally known such that it is not necessary to detail the same here.

The process according to the present invention may also be implemented with a winding machine disclosed in DE 197 37 709.2, which has a design similar to winding machine 1. In this embodiment, the new reel spool already lies oil the rails of the secondary mount before a winding nip is formed between the empty reel spool and the reel drum and the material web is transferred to the empty reel spool. In this winding machine, the reel spool is displaced along a straight guide path during the entire winding process. Accordingly, the present application expressly incorporates by the reference herein in its entirety the disclosure of DE 197 37 709.2.

Accordingly, it must be noted that the control or the regulation of the linear force may be simplified according to the present invention by displacement of the empty reel spool during winding in the primary zone for adjusting the linear force in the winding nip. In addition to the resultant economic advantages, this also leads to a reduction in the incidence of disruptions of the winding machines. Moreover, extremely fine regulation of the linear force at the beginning of the winding process is possible, whereby a particularly good winding result may be realized.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for the continuous winding of a web of material onto a reel spool to form a reel comprising:

forming a winding nip between a peripheral zone of a reel drum and the reel;

guiding the material web over the peripheral zone of the reel drum;

positioning the reel in a secondary zone;

displacing and pressing the reel drum against the reel in the secondary zone, whereby one of control and regulation of a linear force in the winding nip occurs through the displacement of the reel drum;

upon obtaining a completed reel having a desired reel diameter, moving the reel drum into a temporarily fixed position;

introducing a new, empty reel spool into a primary zone;

forming another winding nip between the new reel spool and the reel drum through a relative movement of the new reel spool with respect to the reel drum in the temporarily fixed position;

cutting the material web;

winding the material web onto the new reel spool to form a new reel;

removing the completed reel;

transferring the new reel spool from the primary zone to the secondary zone;

releasing the reel drum from the temporarily fixed position; and displacing the reel drum for one of the control and regulation of the linear force in the winding nip between the reel drum and the new reel spool in the secondary zone.

2. The process according to claim 1, wherein the release of the reel drum from the temporarily fixed position occurs after a diameter of the new reel has reached a predefined value.

3. The process according to claim 1, wherein during the one of the control and regulation of the linear force by displacement of the reel drum, the process further comprising:

relatively moving the reel with respect to the reel drum to compensate for increasing reel diameter.

4. The process according to claim 1, before the winding of the material web onto the new reel spool, the process comprising:

forming a free draw of the material web between the reel drum and an almost completed reel.

5. The process according to claim 4, wherein while the material web is guided in a free length from the reel drum to the almost finished reel, a winding gap is formed between the reel and a pressure roller.

6. The process according to claim 1, wherein after the new reel has been transferred from the primary zone to the secondary zone, the new reel is held stationary for a period of time.

7. The process according to claim 1, wherein during the winding in the primary zone and during the transfer of the new reel from the primary zone to the secondary zone, the process further comprising:

pressing the reel with one of controllable and regulatable force against the reel drum in the temporarily fixed position.

8. The process according to claim 7, wherein the new reel spool, which has been transferred into the secondary zone under the one of controllable and regulatable force is pressed against the reel drum in the temporarily fixed position.

9. The process according to claim 1, wherein the web of material is composed of one of a paper and a cardboard web.

10. A winding machine for the continuous winding of a material web onto a reel spool and to form a reel comprising:

a reel drum arranged to form a winding nip with the reel;

a primary mount adapted to hold a new reel spool, wherein the primary mount is further adapted to displace the new reel spool along a first guide path substantially radially and linearly to the reel drum;

a secondary mount coupled to the reel spool;

a pressure device coupled to the reel drum, the pressure device being adapted to move the reel drum at least substantially horizontally when the reel spool is in the secondary mount, and further adapted to at least temporarily fix a position of the reel drum when the new reel spool is in the primary mount.

11. A winding machine for the continuous winding of a material web onto a reel spool and to form a reel comprising:

a reel drum arranged to form a winding nip with the reel;

a primary mount adapted to hold a new reel spool, wherein the primary mount is further adapted to displace the new reel spool along a first guide path substantially radially to the reel drum;

a secondary mount coupled to the reel spool;

a pressure device coupled to the reel drum, the pressure device being adapted to move the reel drum at least substantially horizontally when the reel spool is in the secondary mount, and further adapted to at least temporarily fix a position of the reel drum when the new reel spool is in the primary mount;

the primary mount comprising:

a displaceable primary pressure device to which the new reel spool is rotatably coupled, and which is adapted to displace the new reel spool in a direction of one of toward a periphery of the reel drum and away from the periphery of the reel drum.

12. A winding machine for the continuous winding of a material web onto a reel spool and to form a reel comprising:

a reel drum arranged to form a winding nip with the reel;

a primary mount adapted to hold a new reel spool, wherein the primary mount is further adapted to displace the new reel spool along a first guide path substantially radially to the reel drum;

a secondary mount coupled to the reel spool;

a pressure device coupled to the reel drum, the pressure device being adapted to move the reel drum at least substantially horizontally when the reel spool is in the secondary mount, and further adapted to at least temporarily fix a position of the reel drum when the new reel spool is in the primary mount;

the primary mount comprising:

a displaceable primary pressure device to which the new reel spool is rotatably coupled, and which is adapted to press the new reel spool with one of a controllable and regulatable force against the reel drum.

13. A winding machine for the continuous winding of a material web onto a reel spool and to form a reel comprising:

a reel drum arranged to form a winding nip with the reel;

a primary mount adapted to hold a new reel spool, wherein the primary mount is further adapted to displace the new reel spool along a first guide path substantially radially to the reel drum;

a secondary mount coupled to the reel spool;

a pressure device coupled to the reel drum, the pressure device being adapted to move the reel drum at least substantially horizontally when the reel spool is in the secondary mount, and further adapted to at least temporarily fix a position of the reel drum when the new reel spool is in the primary mount;

the primary mount comprising a primary pressure device arranged to act on the new reel spool; and the pressure device further comprising:

a pressure source;

a pressure control device; and a valve which is adapted to temporarily couple the primary pressure device to the pressure source through the pressure control device.

14. The winding machine according to claim 13, a valve arrangement adapted to supply one of a controlled and regulated pressure to one of the cylinder and the primary pressure device.

15. A winding machine for the continuous winding of a material web onto a reel spool and to form a reel comprising:

a reel drum arranged to form a winding nip with the reel;

a primary mount adapted to hold a new reel spool, wherein the primary mount is further adapted to displace the new reel spool along a first guide path substantially radially to the reel drum;

a secondary mount coupled to the reel spool;

a pressure device coupled to the reel drum, the pressure device being adapted to move the reel drum at least substantially horizontally when the reel spool is in the secondary mount, and further adapted to at least temporarily fix a position of the reel drum when the new reel spool is in the primary mount;

the pressure device comprising:

a cylinder;

a pressure source;

a pressure control device; and a valve which is adapted to alternatively couple the cylinder to one of directly to the pressure source and to the pressure source through the pressure control device.

16. The winding machine according to claim 15, the pressure control device comprising a regulator.

17. The winding machine according to claims 15, the primary mount comprising a primary pressure device arranged to act on the new reel spool; and the pressure device further comprising;

a second valve which is adapted to temporarily couple the primary pressure device to the pressure source through the pressure control device.

18. A winding machine for the continuous winding of a material web onto a reel spool and to form a reel comprising:

a reel drum arranged to form a winding nip with the reel;

a primary mount adapted to hold a new reel spool, wherein the primary mount is further adapted to displace the new reel spool along a first guide path substantially radially to the reel drum;

a secondary mount coupled to the reel spool;

a pressure device coupled to the reel drum, the pressure device being adapted to move the reel drum at least substantially horizontally when the reel spool is in the secondary mount, and further adapted to at least temporarily fix a position of the reel drum when the new reel spool is in the primary mount;

the pressure device comprising a cylinder, a pressure source, a pressure control device, and a valve which is adapted to alternatively couple the cylinder to one of directly to the pressure source and to the pressure source through the pressure control device;

the primary mount comprising a primary pressure device arranged to act on the new reel spool;

the pressure device further comprising a second valve which is adapted to temporarily couple the primary pressure device to the pressure source through the pressure control device; and the valve and the second valve being adapted to be temporarily coupled, through a common line, to the regulator and the pressure source, wherein both the cylinder and the primary pressure device is temporarily supplied with the one of the controlled and regulated pressure.

19. A winding machine for the continuous winding of a material web onto a reel spool and to form a reel comprising:

a reel drum arranged to form a winding nip with the reel;

a primary mount adapted to hold a new reel spool, wherein the primary mount is further adapted to displace the new reel spool along a first guide path substantially radially to the reel drum;

a secondary mount coupled to the reel spool;

a pressure device coupled to the reel drum, the pressure device being adapted to move the reel drum at least substantially horizontally when the reel spool is in the secondary mount, and further adapted to at least temporarily fix a position of the reel drum when the new reel spool is in the primary mount;

the pressure device comprising a cylinder, a pressure source, a pressure control device, and a valve which is adapted to alternatively couple the cylinder to one of directly to the pressure source and to the pressure source through the pressure control device; and a pressure reducing element provided between the valve and the cylinder, wherein the pressure reducing element is adapted to gradually reduce the maximum pressure prevailing in the cylinder to the one of the controlled and regulated pressure.

20. A winding machine for the continuous winding of a material web onto a reel spool and to form a reel comprising:

a reel drum arranged to form a winding nip with the reel;

a primary mount adapted to hold a new reel spool, wherein the primary mount is further adapted to displace the new reel spool along a first guide path substantially radially to the reel drum;

a secondary mount coupled to the reel spool;

a pressure device coupled to the reel drum, the pressure device being adapted to move the reel drum at least substantially horizontally when the reel spool is in the secondary mount, and further adapted to at least temporarily fix a position of the reel drum when the new reel spool is in the primary mount;

wherein the web of material is composed of one of a paper and a cardboard web.

21. A process for winding a continuous material web reels on reel spools in a winding device including a reel drum, a secondary zone in which axes of the reel drum and a first reel are substantially horizontally oriented, and a primary zone in which a new reel spool is to be arranged to begin winding of a second reel, the process comprising:

moving the reel drum to a temporarily fixed position;

forming a primary winding nip between the reel drum and the new reel spool in the primary zone by moving the new reel spool substantially radially and linearly towards the reel drum;

adjusting a nip pressure in the primary winding nip;

winding the continuous material web on the new reel spool to form a first reel;

transferring the second reel from the primary zone to the secondary zone such that the primary winding nip is moved to become a secondary winding nip between the reel drum and the second reel in the secondary zone;

releasing the reel drum from the temporarily fixed position; and adjusting a nip pressure in the secondary winding nip between the reel drum and the first reel in the secondary zone.

22. A process for winding a continuous material web reels on reel spools in a winding device including a reel drum, a secondary zone in which axes of the reel drum and a first reel are substantially horizontally oriented, and a primary zone in which a new reel spool is to be arranged to begin winding of a second reel, the process comprising:

moving the reel drum to a temporarily fixed position;

forming a primary winding nip between the reel drum and the new reel spool in the primary zone;

adjusting a nip pressure in the primary winding nip;

winding the continuous material web on the new reel spool to form a first reel;

transferring the second reel from the primary zone to the secondary zone such that the primary winding nip is moved to become a secondary winding nip between the reel drum and the second reel in the secondary zone;

releasing the reel drum from the temporarily fixed position; and adjusting a nip pressure in the secondary winding nip between the reel drum and the first reel in the secondary zone;

wherein the winding device includes a pressure source and a pressure control device and a first and second pressure device, the process further comprising:

alternatively coupling the first pressure device directly to the pressure source and indirectly to the pressure source through the pressure control device to move the reel drum and to adjust the nip pressure in the secondary winding nip; and selectively coupling the second pressure device to the pressure source through the pressure control device to adjust the nip pressure in the primary winding nip.

23. The process according to claim 22, wherein the first pressure device comprises a piston coupled to the reel drum and a cylinder, and the moving of the reel drum into the temporarily fixed position comprises:

coupling the first pressure device directly to the pressure source; and moving a piston to an end position within the cylinder, whereby the reel drum is correspondingly moved to an end position.

24. The process according to claim 22, further comprising:

moving the first reel radially outwardly from the reel drum to compensate for increasing diameter of the first reel;

completing the first reel to a predetermined diameter;

positioning a new reel spool in the primary zone;

winding a second reel on the new reel spool in the primary zone;

removing the first reel; and transferring the second reel from the primary zone to the secondary zone.

25. The process according to claim 24, wherein prior to completing the first reel to the predetermined diameter, the process further comprises:

separating the first reel from the reel drum to form an open draw of the material web; and pressing a pressure roll against the first reel to form a reel nip at an end of the open draw.

26. A process for winding a continuous material web reels on reel spools in a winding device including a reel drum, a secondary zone in which axes of the reel drum and a first reel are substantially horizontally oriented, and a primary zone in which a new reel spool is to be arranged to begin winding of a second reel, the process comprising:

moving the reel drum to a temporarily fixed position;

forming a primary winding nip between the reel drum and the new reel spool in the primary zone;

adjusting a nip pressure in the primary winding nip;

winding the continuous material web on the new reel spool to form a first reel;

transferring the second reel from the primary zone to the secondary zone such that the primary winding nip is moved to become a secondary winding nip between the reel drum and the second reel in the secondary zone;

releasing the reel drum from the temporarily fixed position;

adjusting a nip pressure in the secondary winding nip between the reel drum and the first reel in the secondary zone, wherein the winding device includes a pressure source and a pressure control device and a first and second pressure device;

alternatively coupling the first pressure device to one of directly to the pressure source and indirectly to the pressure source through the pressure control device to move the reel drum and to adjust the nip pressure in the secondary winding nip; and selectively coupling the second pressure device to the pressure source through the pressure control device to adjust the nip pressure in the primary winding nip, wherein the first pressure device comprises a piston coupled to the reel drum and a cylinder, and the moving of the reel drum into the temporarily fixed position comprises coupling the first pressure device directly to the pressure source, and moving a piston to an end position within the cylinder, whereby the reel drum is correspondingly moved to an end position, and wherein when the first reel is transferred into the secondary zone, the process further comprises:

switching the first pressure device from a connection directly to the pressure source to indirectly to the pressure source through the pressure control device;

reducing a pressure within the first pressure zone to correspond to a pressure applied through the pressure control device; and concurrently coupling the second pressure device to the pressure source through the pressure control device.

27. The process according to claim 26, further comprising:

moving the reel drum and the first reel until the piston is positioned at a midpoint within the cylinder.

28. A process for winding a continuous material web reels on reel spools in a winding device including a reel drum, a secondary zone in which axes of the reel drum and a first reel are substantially horizontally oriented, and a primary zone in which a new reel spool is to be arranged to begin winding of a second reel, the process comprising:

moving the reel drum to a temporaily fixed position;

forming a primary winding nip between the reel drum and the new reel spool in the primary zone;

adjusting a nip pressure in the primary winding nip;

winding the continuous material web on the new reel spool to form a first reel;

transferring the second reel from the primary zone to the secondary zone such that the primary winding nip is moved to become a secondary winding nip between the reel drum and the second reel in the secondary zone;

releasing the reel drum from the temporarily fixed position;

adjusting a nip pressure in the secondary winding nip between the reel drum and the first reel in the secondary zone, wherein the winding device includes a pressure source and a pressure control device and a first and second pressure device;

alternatively coupling the first pressure device to one of directly to the pressure source and indirectly to the pressure source through the pressure control device to move the reel drum and to adjust the nip pressure in the secondary winding nip; and selectively coupling the second pressure device to the pressure source through the pressure control device to adjust the nip pressure in the primary winding nip, wherein the first pressure device comprises a piston coupled to the reel drum and a cylinder, and the moving of the reel drum into the temporaily fixed position comprises coupling the first pressure device directly to the pressure source, and moving a piston to an end position within the cylinder, whereby the reel drum is correspondingly moved to an end position, and the adjusting of the nip pressure in the primary winding nip comprising coupling the second pressure device to the pressure source through the pressure control device, whereby the pressure applied to the second pressure device is less than the pressure applied to the first pressure device.

29. The process according to claim 20, further comprising maintaining nip pressure between the reel drum and the first reel via the second pressure device during the transfer of the first reel from the primary zone to the secondary zone.

* * * * *